US010969721B2

(12) United States Patent
Honda

(10) Patent No.: US 10,969,721 B2
(45) Date of Patent: Apr. 6, 2021

(54) IMAGE FORMING APPARATUS

(71) Applicant: CANON KABUSHIKI KAISHA, Tokyo (JP)

(72) Inventor: Kazuhiro Honda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/917,236

(22) Filed: Jun. 30, 2020

(65) Prior Publication Data

US 2021/0011408 A1 Jan. 14, 2021

(30) Foreign Application Priority Data

Jul. 8, 2019 (JP) ..... JP2019-126695
May 14, 2020 (JP) ..... JP2020-084984

(51) Int. Cl.
*G03G 15/00* (2006.01)
*G03G 21/16* (2006.01)

(52) U.S. Cl.
CPC ..... *G03G 15/50* (2013.01); *G03G 15/55* (2013.01); *G03G 21/1638* (2013.01)

(58) Field of Classification Search
CPC ..... G03G 15/50; G03G 15/55; G03G 15/553; G03G 21/1633; G03G 21/1638; G03G 21/1652; G03G 21/169; G03G 21/1878; G03G 2221/1823
USPC ..... 399/9–1, 24–31
See application file for complete search history.

(56) References Cited

U.S. PATENT DOCUMENTS 7,349,648 B2 * 3/2008 Rennick ..... G03G 21/1638 399/110
8,396,379 B2 * 3/2013 Tsukijima ..... G03G 15/0865 399/27
8,509,651 B2 * 8/2013 Tsukijima ..... G03G 15/0856 399/114

FOREIGN PATENT DOCUMENTS

JP 2007-295371 11/2007
JP 2009-099000 5/2009

* cited by examiner

*Primary Examiner* — Hoan H Tran
(74) *Attorney, Agent, or Firm* — Venable LLP

(57) ABSTRACT

An image forming apparatus including an image forming unit, which is detachably mounted to the image forming apparatus. The image forming unit includes a storage unit configured to store a computer program for forming an image on the sheet; a detector configured to detect whether the image forming unit and the controller are connected to each other; a door to be opened to draw out the image forming unit from the image forming apparatus; and a locking unit configured to switch between a locked state and an unlocked state. The controller is configured to rewrite the computer program stored in the storage unit under a state in which the locking unit is in the locked state and the detector detects the connection between the image forming unit and the controller.

30 Claims, 9 Drawing Sheets

| REWRITE OF PROGRAM |
| --- |
| PLEASE CONNECT FIXING/CONVEYING UNIT TO REWRITE PROGRAM OF FIXING/CONVEYING UNIT |

FIG. 7

IMAGE FORMING APPARATUS

BACKGROUND OF THE INVENTION

Field of the Invention

The present disclosure relates to control of writing a computer program or data into a unit that is detachably mounted to a main body of an apparatus, for example, an image forming apparatus.

Description of the Related Art

An image forming apparatus includes a plurality of units, and is configured to control an operation of each unit to form an image on a sheet. For example, the image forming apparatus includes a sheet conveying portion configured to convey a sheet, and a fixing portion configured to fix an image to the sheet. In some cases, the sheet conveying portion and the fixing portion are integrated to be detachably mounted to a main body of the image forming apparatus. A unit in which the sheet conveying portion and the fixing portion are integrated is referred to as "fixing/conveying unit". With the fixing/conveying unit, work efficiency and operability in, for example, jam handling operation are improved, and a space inside the image forming apparatus for jam handling operation is not required.

In order to control a load arranged at each location, the image forming apparatus includes, in each unit, a central processing unit (CPU) configured to control an operation of the load. A CPU configured to control a load is also installed in the fixing/conveying unit. The CPU of each unit is configured to execute a predetermined computer program to control an operation of the corresponding unit (load). The computer program of each unit and a computer program executed by a CPU on the main body side or a computer program of another unit operate normally in synchronization with each other depending on its combination. In Japanese Patent Application Laid-open No. 2007-295371, there is disclosed an image forming apparatus configured to check a combination of versions of computer programs of respective units to determine whether the combination may cause an abnormality.

The fixing/conveying unit includes a non-volatile memory. The non-volatile memory stores data, for example, a usage amount of the fixing/conveying unit. There is a limitation on the number of times of write to the non-volatile memory, and an overhead occurs in write processing. Thus, the usage amount of the fixing/conveying unit is written into the non-volatile memory in accordance with such an operation sequence that the main body temporarily buffers the usage amount during a job, and after the job is finished, the main body writes the usage amount all at once under a state in which the load is stopped and the usage amount does not change. When the fixing/conveying unit is drawn out from the main body when data is being written into the non-volatile memory, the data cannot be written into the non-volatile memory. In Japanese Patent Application Laid-open No. 2009-099000, there is disclosed a locking apparatus configured to prevent discharge of a memory card during an access period in order to prevent a state in which read/write processing cannot be executed during access to the memory card.

Some image forming apparatus include a locking mechanism for preventing the fixing/conveying unit from being drawn out from the main body. The locking mechanism prevents the fixing/conveying unit from being drawn out when a sheet has a possibility of being torn during jam handling operation. The locking mechanism releases locking when a jam has not occurred and the image forming apparatus is not in operation. In this case, the fixing/conveying unit can be drawn out from the main body for maintenance, for example.

The computer program to be executed by the CPU included in a unit is stored in a rewritable memory included in the unit. When the computer program is updated, the computer program stored in the memory is rewritten. The computer program is rewritten while the CPU installed on the main body side and the CPU of the unit are communicating to/from each other. The computer program is rewritten so that the versions of computer programs to be executed by the CPU installed on the main body side and the CPU of the unit match each other.

Further, the computer program is rewritten under a state in which the image forming apparatus is not in operation. When the image forming apparatus is not in operation, the locking mechanism releases locking. Thus, it is possible to draw out the unit from the main body during rewrite of the computer program. When the unit is drawn out from the main body, the CPU installed on the main body side and the CPU of the unit are disconnected. In this case, the computer program to be executed by the CPU on the main body side may be rewritten, and the computer program to be executed by the CPU on the unit side may not be rewritten. As a result, there is a possibility that the versions of computer programs do not match each other, and thus a normal operation cannot be performed.

Further, the CPU on the main body side writes data into the non-volatile memory after processing of stopping an operation of the image forming apparatus. When an operator determines that the image forming apparatus has stopped due to the operation stop processing, and draws out the unit from the main body, the CPU on the main body side and the non-volatile memory may be disconnected, resulting in a possibility that write processing is abnormally finished, or the non-volatile memory fails. In view of this, there is a demand for an image forming apparatus having a mechanism for preventing the unit from being drawn out from the main body when the main body rewrites the computer program of the unit.

SUMMARY OF THE INVENTION

An image forming apparatus, comprising: an image forming unit, which is detachably mounted to the image forming apparatus, and includes an image forming portion configured to form an image on a sheet, the image forming unit including a storage unit configured to store a computer program for forming an image on the sheet; a controller configured to control the image forming unit mounted to the image forming apparatus; a detector configured to detect whether the image forming unit and the controller are connected to each other; a door to be opened to draw out the image forming unit from the image forming apparatus; and a locking unit configured to switch between a locked state, in which the door is prevented from being opened, and an unlocked state, in which the door is allowed to be opened, wherein the controller is configured to rewrite the computer program stored in the storage unit under a state in which the locking unit is in the locked state and the detector detects the connection between the image forming unit and the controller.

Further features of the present invention will become apparent from the following description of exemplary embodiments (with reference to the attached drawings).

BRIEF DESCRIPTION OF THE DRAWINGS

FIG. 7 is an exemplary diagram of a screen for urging connection of a fixing/conveying unit.

DESCRIPTION OF THE EMBODIMENTS

Now, at least one embodiment of the present disclosure is described in detail with reference to the drawings.

Image Forming Apparatus

Figure 1:
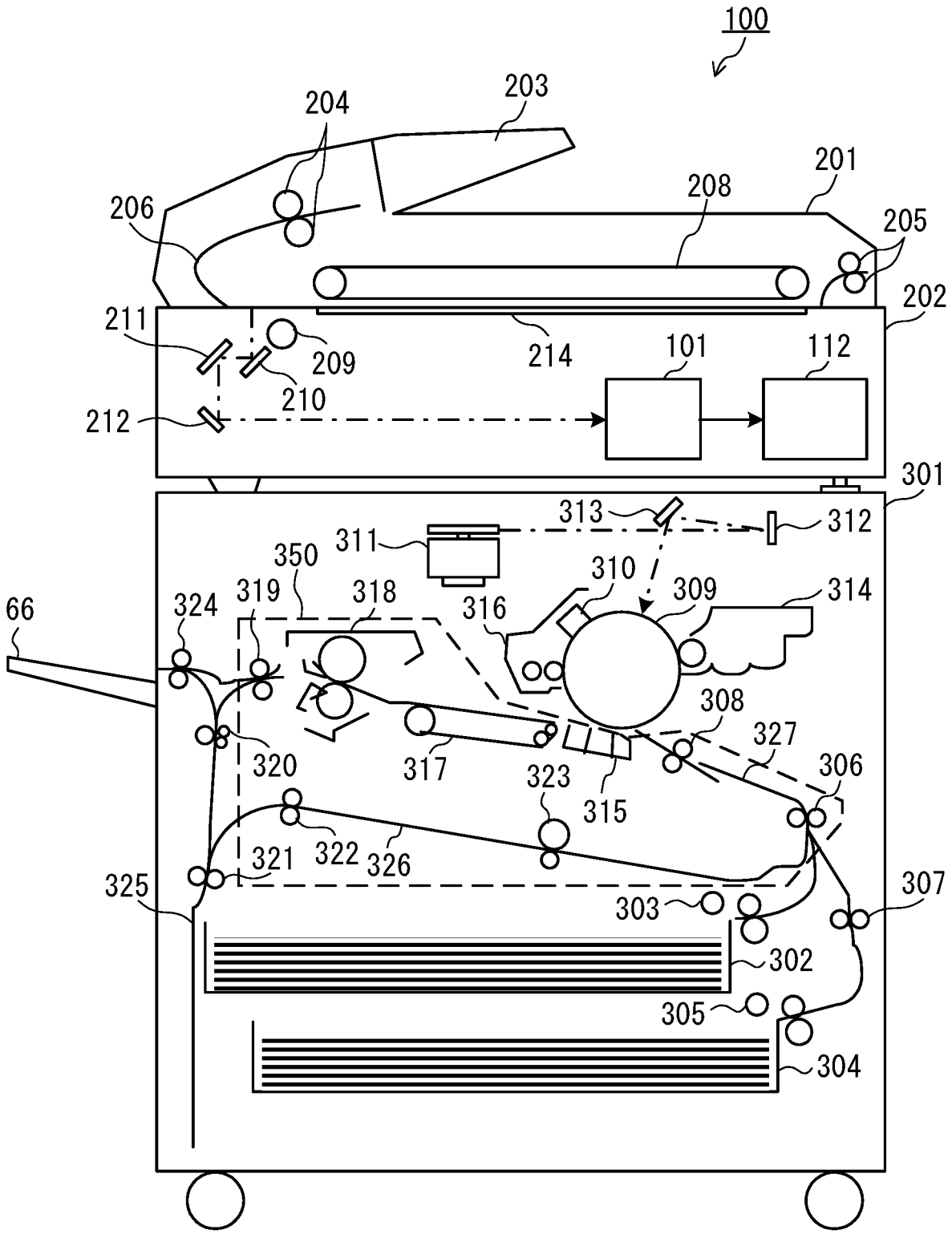
FIG. 1 is a configuration diagram of an image forming apparatus according to at least one embodiment of the present disclosure.

FIG. 1 is a configuration diagram of an image forming apparatus according to at least one embodiment of the present disclosure. An image forming apparatus 100 according to at least one embodiment is a monochrome electrophotographic copying machine. The image forming apparatus 100 is not limited to a copying machine, and may be, for example, a facsimile machine, a printing machine, or a printer. Further, the recording method is not limited to the electrophotographic method, and may be, for example, an inkjet recording method. Further, the image forming apparatus 100 may be any one of a monochrome image forming apparatus and a color image forming apparatus.

The image forming apparatus 100 includes an automatic original conveying portion 201, an original reading portion 202, and an image forming portion 301. The automatic original conveying portion 201 is configured to convey an original on which an image is formed to a position at which the original reading portion 202 is to read the image. The original reading portion 202 is configured to read the image from the original, generate image data representing the read image, and transmit the generated image data to the image forming portion 301. The image forming portion 301 is configured to execute image forming processing based on the image data acquired from the original reading portion 202 to form an image on the sheet.

The automatic original conveying portion 201 includes an original tray 203 on which an original is to be placed, sheet feeding rollers 204, a conveyance path 206, a conveyance belt 208, and sheet delivery rollers 205. The original placed on the original tray 203 is fed into the automatic original conveying portion 201 by the sheet feeding rollers 204 one by one. The fed original is conveyed along the conveyance path 206 to a position at which the original reading portion 202 is to read the original. The image of the original is read by the original reading portion 202 when the original passes through the reading position. The original, which has passed through the reading position, is conveyed by the conveyance belt 208 at a constant speed, and is discharged to a delivery tray (not shown) by the sheet delivery rollers 205.

The original reading portion 202 includes a platen 214, a lighting device 209, reflection mirrors 210, 211, and 212, a photoelectric conversion portion 101, and an image processing portion 112. The platen 214 is a position at which the original reading portion 202 is to read an image, and an original is conveyed to the platen 214 from the automatic original conveying portion 201. The lighting device 209 illuminates an original on the platen 214 with light. Light radiated by the lighting device 209 and reflected by the original is guided to the photoelectric conversion portion 101 by an optical system including the reflection mirrors 210, 211, and 212.

The photoelectric conversion portion 101 is configured to receive reflected light to convert the received reflected light into an image signal representing an image of the original. The photoelectric conversion portion 101 includes, for example, a lens, a charge coupled device (CCD) being a photoelectric conversion element, and a circuit for driving the CCD. The image processing portion 112 is configured to subject the image signal output from the photoelectric conversion portion 101 to various kinds of image processing to generate image data. The image processing portion 112 includes a hardware device, for example, an application specific integrated circuit (ASIC). The generated image data is transmitted to the image forming portion 301. In this manner, an image is read from the original, and image data representing the image is input to the image forming portion 301.

The original reading portion 202 can set a flow-reading mode and a fixed-reading mode as modes for reading the image of an original. As described above, the flow-reading mode is a mode for reading an image while the automatic original conveying portion 201 is conveying an original at a fixed speed. In the flow-reading mode, the lighting device 209 and the optical system are fixed at predetermined positions. The fixed-reading mode is a mode for reading an image from an original placed on the platen 214 by an operator without using the automatic original conveying portion 201. In the fixed-reading mode, an image is read while the lighting device 209 and the optical system are moving below the platen 214 at a fixed speed. In general, an original being a sheet is read in the flow-reading mode, whereas bound originals, such as a book or a booklet, are read in the fixed-reading mode.

The image forming portion 301 includes sheet storage trays 302 and 304. The sheet storage trays 302 and 304 can store different types of sheets. For example, the sheet storage tray 302 stores A4 plain paper, and the sheet storage tray 304 stores A4 thick paper. The sheet is a recording medium on which an image is formed by the image forming apparatus 100, and is, for example, paper, a resin sheet, a cloth, an OHP sheet, or a label.

The image forming portion 301 includes sheet feeding rollers 303 and 305 for feeding sheets from the sheet storage trays 302 and 304 to a conveyance path 327, respectively. The conveyance path 327 includes conveyance rollers 307 and 306 and registration rollers 308. A sheet stored in the sheet storage tray 302 is fed by the sheet feeding roller 303, and is conveyed to the registration rollers 308 by the conveyance rollers 306. A sheet stored in the sheet storage tray 304 is fed by the sheet feeding roller 305, and is conveyed to the registration rollers 308 by the conveyance rollers 307 and 306. The registration rollers 308 correct skew feed of a sheet with respect to a conveying direction thereof.

The image forming portion 301 includes a photosensitive drum 309 on which an image is to be formed. A charging device 310, an exposing device 311, a developing device 314, and a drum cleaner 316 are arranged around the photosensitive drum 309. The photosensitive drum 309 is a photosensitive member having a drum shape. A photosensitive layer is formed on the surface of the photosensitive member. The photosensitive drum 309 rotates clockwise in FIG. 1. The charging device 310 is configured to uniformly charge the surface (photosensitive layer) of the rotating photosensitive drum 309. The charging device 310 is, for example, a corona charging device or a charging roller. The exposing device 311 is a light scanning device including a semiconductor laser and a polygon mirror. The exposing device 311 is configured to radiate laser light, which has been modulated based on the image data acquired from the original reading portion 202, to the charged surface of the photosensitive drum 309. The laser light emitted by the exposing device 311 scans the surface of the photosensitive drum 309 via mirrors 312 and 313. As a result, an electrostatic latent image that depends on the image data is formed on the surface of the photosensitive drum 309. The developing device 314 is configured to develop the electrostatic latent image on the photosensitive drum 309 by developer (toner). With this, a toner image is formed on the surface of the photosensitive drum 309.

The image forming portion 301 includes a transfer portion 315, a conveyance belt 317, and a fixing device 318 in order to transfer a toner image onto a sheet and fix the toner image. The transfer portion 315 is installed at a position (transfer position) opposite to the photosensitive drum 309. A sheet is conveyed to the transfer position by the registration rollers 308 in synchronization with a timing at which the toner image formed on the photosensitive drum 309 is conveyed to the transfer position through rotation of the photosensitive drum 309. The transfer portion 315 is configured to transfer the toner image from the photosensitive drum 309 onto the conveyed sheet.

After the transfer of the toner image onto the sheet, toner remaining on the photosensitive drum 309 is removed by the drum cleaner 316. The photosensitive drum 309 whose surface has been cleaned by the drum cleaner 316 is used for next image forming processing. The drum cleaner 316 stores the removed remaining toner into a collected toner box (not shown) as collected toner.

The sheet onto which the toner image has been transferred is conveyed to the fixing device 318 by the conveyance belt 317. The fixing device 318 includes a pair of rollers. At least one of the pair of rollers includes a heater (fixing heater) being a heat source. The fixing device 318 is configured to heat and pressurize the sheet on which the toner image has been transferred by the pair of rollers, to thereby fix the toner image to the sheet. In this manner, the formation of an image onto a sheet is finished.

The image forming portion 301 can operate in a single-sided printing mode, in which an image is formed on one side of a sheet, and a double-sided printing mode, in which the image is formed on both sides of the sheet. To achieve this, the image forming portion 301 includes sheet delivery rollers 319 and 324, conveyance rollers 320, reverse rollers 321, conveyance rollers 322 and 323, and reverse paths 325 and 326. In the case of the single-sided printing mode, a sheet that has passed through the fixing device 318 is discharged to a delivery tray 66 by the sheet delivery rollers 319 and 324. In the case of the double-sided printing mode, a sheet on which an image is formed on the first surface by the fixing device 318 is conveyed to the reverse path 325 by the sheet delivery rollers 319, the conveyance rollers 320, and the reverse rollers 321. After that, the sheet is conveyed to the registration rollers 308 by the conveyance rollers 322 and 323 through the reverse path 326, and an image is formed on the second surface similarly to the case of the first surface. The sheet on which the images are formed on the first surface and the second surface is delivered to the delivery tray 66 by the sheet delivery rollers 319 and 324.

When the sheet on which the image is formed on the first surface is discharged so as to face downward, the sheet that has passed through the fixing device 318 is conveyed to the conveyance rollers 320 by the sheet delivery rollers 319. After that, the rotation of the conveyance rollers 320 is reversed immediately before a trailing end of the sheet passes through a nip portion of the conveyance rollers 320. As a result, the sheet is discharged to the delivery tray 66 from the sheet delivery rollers 324 under a face-down state, in which the first surface of the sheet faces downward.

The image forming apparatus 100 is configured as described above to copy the image of the original. In at least one embodiment, the conveyance rollers 306, the registration rollers 308, the transfer portion 315, the conveyance belt 317, the fixing device 318, the sheet delivery rollers 319, the conveyance rollers 322 and 323, the reverse path 326, and the conveyance path 327 are referred to as "fixing/conveying unit 350". The components of the fixing/conveying unit 350 included in a range indicated by the broken line of FIG. 1 are supported by a supporting frame mounted to the main body of the image forming portion 301 so that the supporting frame can be drawn out from the main body. The fixing/conveying unit 350 is detachably mounted to the main body of the image forming portion 301 by the supporting frame. The fixing/conveying unit 350 is a unit including conveyance members (e.g., roller and belt) for conveying a sheet inside the image forming portion 301, guide members (conveyance path 327 and reverse path 326) for guiding the sheet, and the fixing device 318.

In the following description, a load is an object to be driven by a motor. For example, various kinds of rollers (conveyance rollers) such as the sheet feeding rollers 204, 303, and 305, the registration rollers 308, and the sheet delivery rollers 319, the photosensitive drum 309, the conveyance belts 208 and 317, the lighting device 209, and the optical system correspond to the load in at least one embodiment.

Opening/Closing of Door of Image Forming Apparatus 100

Figure 2A:
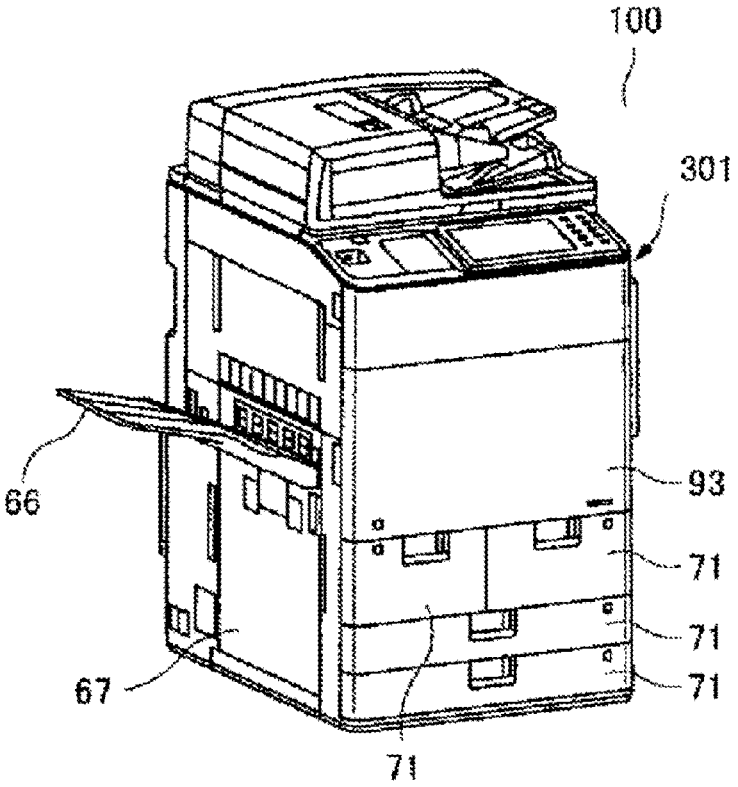
FIG. 2A and FIG. 2B are each an explanatory view of a configuration for accessing the internal structure.
Figure 2B:
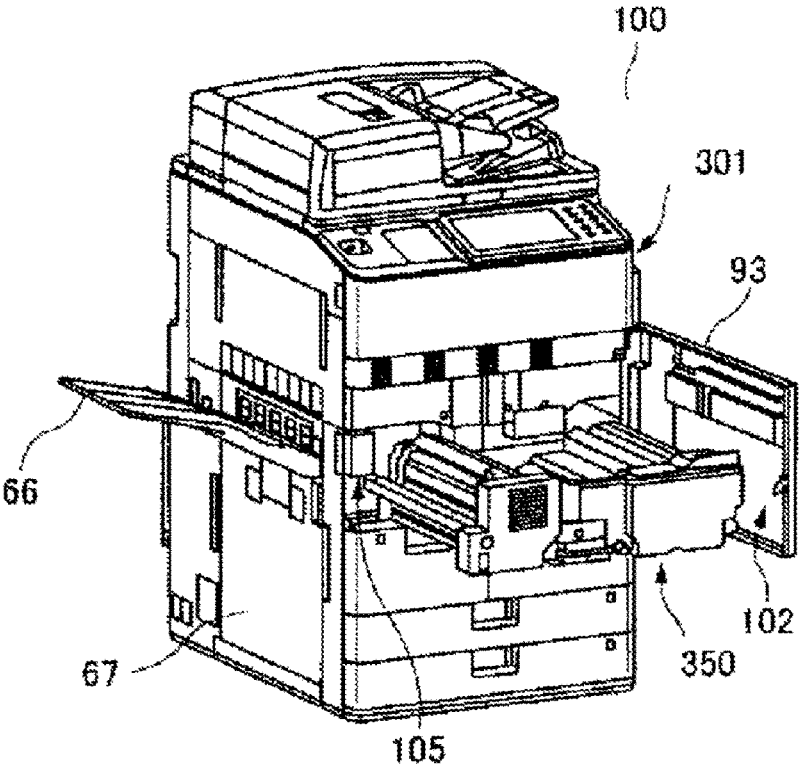

FIG. 2A and FIG. 2B are each an explanatory view of a configuration for accessing the internal structure of the image forming apparatus 100. The image forming apparatus 100 includes a front door 93 on a front surface of the main body of the image forming portion 301, and a side door 67 on a side on which the delivery tray 66 is arranged. The front door 93 and the side door 67 are mounted so as to be freely opened or closed with respect to the main body. It is possible to access the internal structure when the front door 93 and the side door 67 are in an opened state. Further, in the image forming apparatus 100 of FIG. 2A and FIG. 2B, four sheet storage trays 71 are installed so as to be drawn out from the main body.

FIG. 2A represents a closed state of the front door 93. FIG. 2B represents an opened state of the front door 93. As illustrated in FIG. 2B, when the front door 93 is in the opened state, the fixing/conveying unit 350 can be drawn out from the main body of the image forming portion 301 toward the front side. The front door 93 is rotatably mounted to the main body of the image forming portion 301 at a right end from the viewpoint of the front side, and includes a hook portion 102 at a left end. A locking unit 105, with which the hook portion 102 can engage at a position corresponding to the hook portion 102, is installed on the main body side of the image forming portion 301.

Figure 3A:
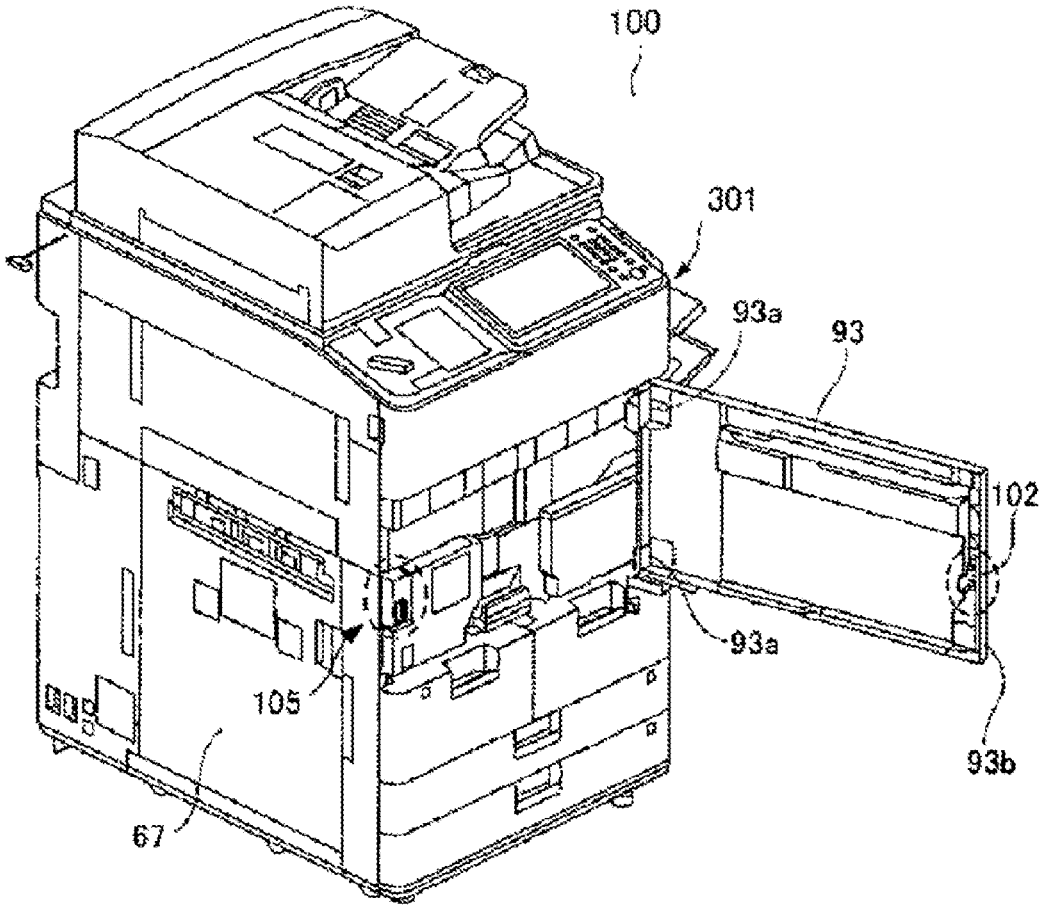
FIG. 3A, FIG. 3B, and FIG. 3C are each an explanatory view of a locking mechanism of a front door.
Figure 3B:
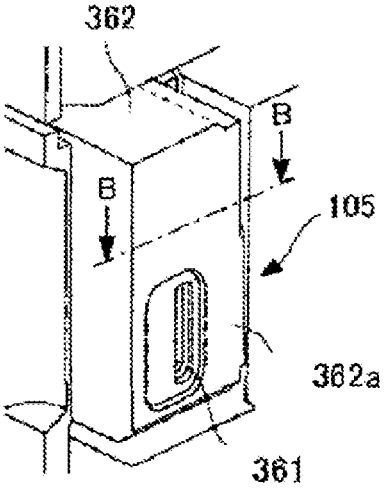
Figure 3C:
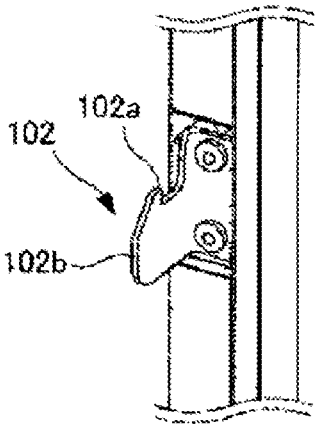

FIG. 3A to FIG. 3C are each an explanatory view of a locking mechanism of the front door 93. The front door 93 is locked by the locking mechanism in the closed state. As illustrated in FIG. 3A, the front door 93 is supported rotatably with respect to the main body of the image forming portion 301 with a hinge portion 93*a* installed at the right end from the viewpoint of the front side serving as an axis. A left-end portion 93*b* is drawn toward the front side, and then the front door 93 becomes the opened state. The hook portion 102 with which the locking unit 105 is to engage is installed in the left end portion 93*b*.

As illustrated in FIG. 3B, the locking unit 105 is covered by a cover member 362 fixed to the main body of the image forming portion 301. The cover member 362 is a casing having approximately a rectangular parallelepiped shape, and an opening 361 into which the hook portion 102 is to be inserted is formed on the front portion 362*a*. As illustrated in FIG. 3C, the hook portion 102 is formed to have a hook shape including an engaging portion 102*a* with which the locking unit 105 is to engage and a distal end portion 102*b* protruding from the front door 93 toward the main body of the image forming portion 301.

Figure 4A:
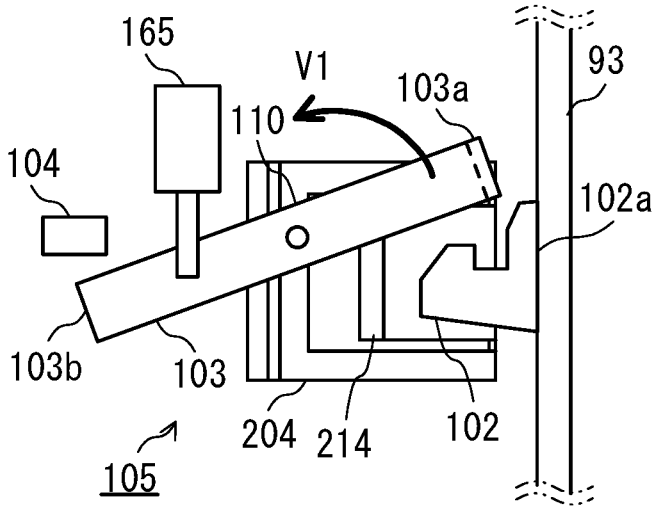
FIG. 4A and FIG. 4B are each an explanatory view of a locked state.
Figure 4B:
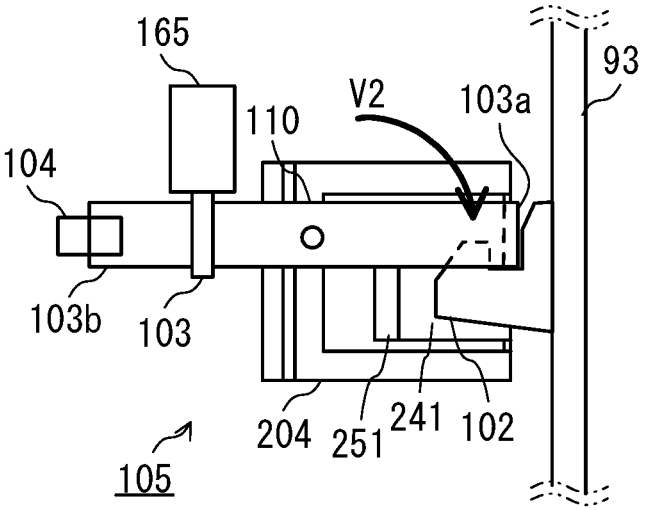

FIG. 4A and FIG. 4B are each an explanatory view of the locked state. FIG. 4A represents a state at the time of releasing locking. When the locking is released, the front door 93 can be opened or closed. FIG. 4B represents a state at the time of locking. At the time of locking, the front door 93 is fixed in a closed state.

As illustrated in FIG. 4A, the locking unit 105 includes a locking member 103 and a solenoid lock 165. The locking member 103, which is an example of the locking portion, includes a distal end portion 103*a* capable of holding the hook portion 102 in contact with the engaging portion 102*a* of the hook portion 102. The locking member 103 is a pivot member that can pivot with respect to a supporting shaft 110. When the solenoid lock 165 is in an off state (FIG. 4A), the distal end portion 103*a* of the locking member 103 turns toward a release position (in the direction of the arrow V1) away from the hook portion 102 due to its own weight.

The solenoid lock 165 is connected to the locking member 103 on a side 103*b* opposite to the distal end portion 103*a* with respect to the supporting shaft 110 in the locking member 103. When the solenoid lock 165 is in an on state (FIG. 4B), the locking member 103 is attracted by the solenoid lock 165 and turns toward a direction of the arrow V2. At this time, the distal end portion 103*a* engages with the engaging portion 102*a* of the hook portion 102, and is held at a position of engaging with the hook portion 102.

Controller

Figure 5:
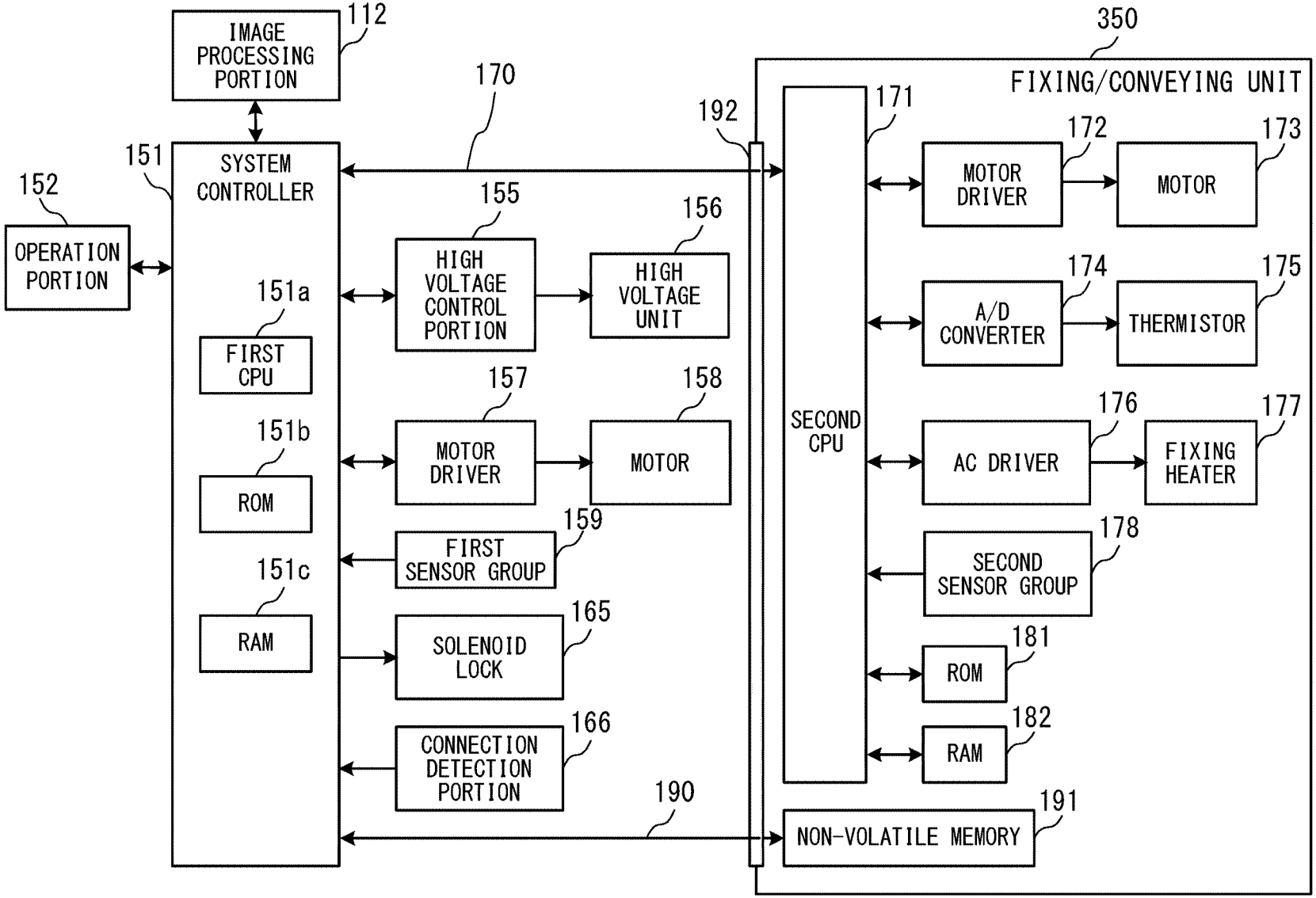
FIG. 5 is an explanatory diagram of a controller.

FIG. 5 is an explanatory diagram of the controller configured to control an operation of the image forming apparatus 100. In FIG. 5, a description is given of a configuration in which a system controller 151 configured to control an overall operation of the image forming portion 301 controls an operation of the fixing/conveying unit 350. The operations of units other than the fixing/conveying unit 350 that are installed in the image forming portion 301 are also controlled by the system controller 151 in a similar manner.

The system controller 151 includes a first CPU 151*a*, a read only memory (ROM) 151*b*, and a random access memory (RAM) 151*c*. The system controller 151 is connected to a high voltage control portion 155, a motor driver 157, a first sensor group 159, a solenoid lock 165, a connection detection portion 166, and a fixing/conveying unit 350, which are included in the image forming portion 301. The system controller 151 is connected to the image processing portion 112 and an operation portion 152 of the original reading portion 202. The system controller 151 is configured to transmit/receive data or a command to/from each connected portion.

The first CPU 151*a* is configured to execute a computer program stored in the ROM 151*b*, to thereby control an operation of each unit of the image forming apparatus 100 to execute image forming processing. The RAM 151*c* provides a working area at the time of execution of processing by the first CPU 151*a*. Further, the RAM 151*c* is a storage device that stores various kinds of data such as a set value for the high voltage control portion 155 and information acquired from the operation portion 152. A battery unit (not shown) is connected to the RAM 151*c*, and data is held also when the power supply of the image forming apparatus 100 is off.

The system controller 151 transmits, to the image processing portion 112, a set value for each unit included in the image forming apparatus 100, which is required for image processing by the image processing portion 112. The system controller 151 receives a signal (signal (detection result) from first sensor group 159, for example) from each unit, and sets a set value for each unit. For example, the system controller 151 sets the set value for the high voltage control portion 155 based on the received signal. The high voltage control portion 155 supplies a required voltage to a high voltage unit 156 (e.g., charging device 310, developing device 314, or transfer portion 315) depending on the set value set by the system controller 151. The first sensor group 159 includes, for example, a sensor configured to detect a sheet conveyed by the conveyance roller.

The solenoid lock 165 is configured to operate the locking mechanism of the front door 93 described above in accordance with an instruction from the first CPU 151*a*. The connection detection portion 166 is configured to detect whether the fixing/conveying unit 350 is connected to the main body of the image forming portion 301. The connection detection portion 166 is configured to detect whether the fixing/conveying unit 350 is connected to the main body of the image forming portion 301 depending on whether the connection detection portion 166 communicates normally to/from the fixing/conveying unit 350 via a communication line 170 and a communication line 190 described later, for example. The motor driver 157 is configured to control an operation of a motor 158 for driving a load in accordance with an instruction from the first CPU 151*a*.

The fixing/conveying unit 350 includes a second CPU 171, a ROM 181, and a RAM 182. The second CPU 171 is connected to the system controller 151 via the communication line 170. The second CPU 171 is configured to execute a computer program stored in the ROM 181 in accordance with an instruction from the system controller 151, to thereby control an operation of the fixing/conveying unit 350. The ROM 181 is a rewritable memory. The second CPU 171 can rewrite a computer program stored in the ROM 181 in accordance with an instruction from the system controller 151. The RAM 182 provides a working area at the time of execution of processing by the second CPU 171. A motor driver 172, an A/D converter 174, an AC driver 176, and a second sensor group 178 are connected to the second CPU 171.

The motor driver 172 is configured to control an operation of a motor 173 for driving a load of the fixing/conveying unit 350 in accordance with an instruction from the second CPU 171. A thermistor 175 for detecting a temperature of a fixing heater 177 is connected to the A/D converter 174. The A/D converter 174 is configured to receive a detection signal indicating a detection result from the thermistor 175, convert this detection signal from an analog signal into a digital signal, and transmit the digital signal to the second CPU 171. The second CPU 171 controls the AC driver 176 based on the digital signal received from the A/D converter 174. The AC driver 176 is controlled by the second CPU 171 to control an amount of heat of the fixing heater 177 so that the temperature of the fixing heater 177 reaches a temperature required for executing fixing processing.

The second CPU 171 is configured to control a load included in the fixing/conveying unit 350 based on an instruction from the system controller 151 acquired via the communication line 170. Further, the second CPU 171 is configured to transmit a detection result of the thermistor 175 or the second sensor group 178 to the system controller 151 via the communication line 170. The second sensor group 178 includes, for example, a sensor configured to detect a sheet conveyed by the conveyance roller in the fixing/conveying unit 350.

Further, the fixing/conveying unit 350 includes a non-volatile memory 191. The non-volatile memory 191 is connected to the system controller 151 via the communication line 190. The non-volatile memory 191 stores data, for example, the usage amount of the fixing/conveying unit 350 written by the first CPU 151*a*.

The communication line 170 and the communication line 190 are each a signal line connected to the fixing/conveying unit 350 by a connector 192 (e.g., drawer connecter) installed in the fixing/conveying unit 350. When the fixing/conveying unit 350 is drawn out from the main body of the image forming portion 301, the communication line 170 and the communication line 190 are drawn out from connectors. In this case, the communication between the system controller 151 and the fixing/conveying unit 350 is disconnected.

The operation portion 152 is a user interface including an input device such as an input key, a numeric keypad, a touch panel, and an output device such as a display or a speaker. The system controller 151 is configured to display, on a display of the operation portion 152, a screen for performing various kinds of setting at the time of forming an image to urge an operator to input settings by the input device. For example, the system controller 151 controls the operation portion 152 so as to display, on a display installed on the operation portion 152, an operation screen for the operator to perform setting of, for example, the type of a sheet for forming an image. The system controller 151 receives an instruction input by the operator using the operation portion 152 based on the operation screen. The system controller 151 controls the operation of the image forming apparatus 100 based on details of the instruction received from the operation portion 152, and forms an image on a sheet having the specified type.

The system controller 151 transmits, to the operation portion 152, information representing the state of the image forming apparatus 100. The information representing the state of the image forming apparatus 100 is, for example, the number of sheets on which an image is to be formed, whether an image is being formed, or occurrence of a jam and its location. The operation portion 152 displays, on a display, information received from the system controller 151.

Processing of Rewriting Computer Program of Fixing/Conveying Unit

Figure 6:
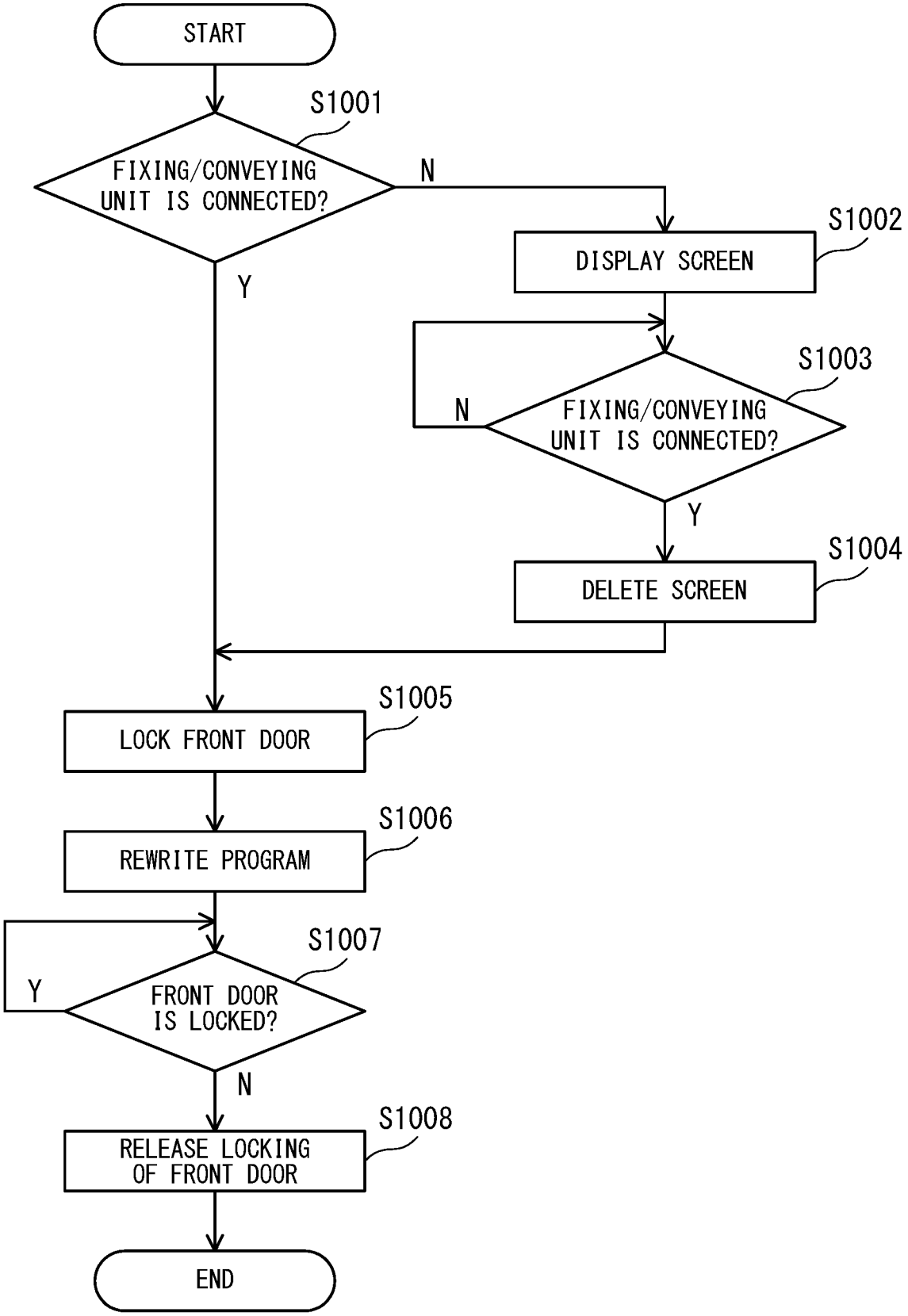
FIG. 6 is a flow chart for illustrating processing of rewriting a computer program.

FIG. 6 is a flow chart for illustrating processing of rewriting a computer program of the fixing/conveying unit 350 by the system controller 151. The computer program is rewritten at the time of updating software to be used by the image forming apparatus 100, for example.

The first CPU 151*a* of the system controller 151 uses the connection detection portion 166 to determine whether the fixing/conveying unit 350 is connected to the main body of the image forming portion 301 (Step S1001). When the fixing/conveying unit 350 is not connected (Step S1001: N), the first CPU 151*a* uses the operation portion 152 to give a notification urging connection of the fixing/conveying unit 350. Specifically, the first CPU 151*a* displays, on the operation portion 152, a screen for urging connection of the fixing/conveying unit 350 (Step S1002). FIG. 7 is an exemplary diagram of the screen for urging connection of the fixing/conveying unit 350. The first CPU 151*a* waits until the connection detection portion 166 determines that the fixing/conveying unit 350 is connected to the main body of the image forming portion 301 (Step S1003: N). When the connection detection portion 166 has determined that the fixing/conveying unit 350 is connected to the main body of the image forming portion 301 (Step S1003: Y), the first CPU 151*a* deletes display of the screen for urging connection of the fixing/conveying unit 350 (Step S1004).

When the fixing/conveying unit 350 is connected to the main body of the image forming portion 301, the first CPU 151*a* turns on the solenoid lock 165 to lock the front door 93 in the closed state (Step S1005). The fixing/conveying unit 350 cannot be drawn out from the main body of the image forming portion 301 due to the fact that the front door 93 is locked in the closed state. That is, the connection between the system controller 151 and the fixing/conveying unit 350 is maintained. Under this state, the first CPU 151*a* rewrites a computer program to be executed by the second CPU 171 via the communication line 170 (Step S1006). The second CPU 171 stores the computer program acquired from the first CPU 151*a* via the communication line 170 into the ROM 181, to thereby rewrite the computer program. The connection between the system controller 151 and the fixing/conveying unit 350 is maintained at the time of rewriting the computer program, and thus the computer program is rewritten normally.

When the rewrite of the computer program is finished, the first CPU 151*a* determines whether the front door 93 is locked due to a jam removal processing cause described later (Step S1007). When the front door 93 is locked due to the jam removal processing cause (Step S1007: Y), the first CPU 151*a* waits until the jam removal processing cause is removed. When the front door 93 is not locked (Step S1007: N), the first CPU 151*a* turns off the solenoid lock 165 to release locking of the front door 93 (Step S1008). Through the above-mentioned processing, the computer program of the fixing/conveying unit 350 is rewritten.

As described above, the front door 93 covering the fixing/conveying unit 350 is locked during the rewrite of the computer program of the fixing/conveying unit 350 even under a situation in which the image forming apparatus 100 is not in operation. As a result, even when the operator tries to draw out the fixing/conveying unit 350 from the main body of the image forming portion 301, the fixing/conveying unit 350 cannot be drawn out from the main body during the rewrite of the computer program of the fixing/conveying unit 350. With this configuration, the computer program is reliably rewritten without causing the disconnection between the fixing/conveying unit 350 and the system controller 151 due to the separation therebetween. Further, it is possible to prevent a failure of the ROM 181.

Processing at time of Forming Image

Figure 8:
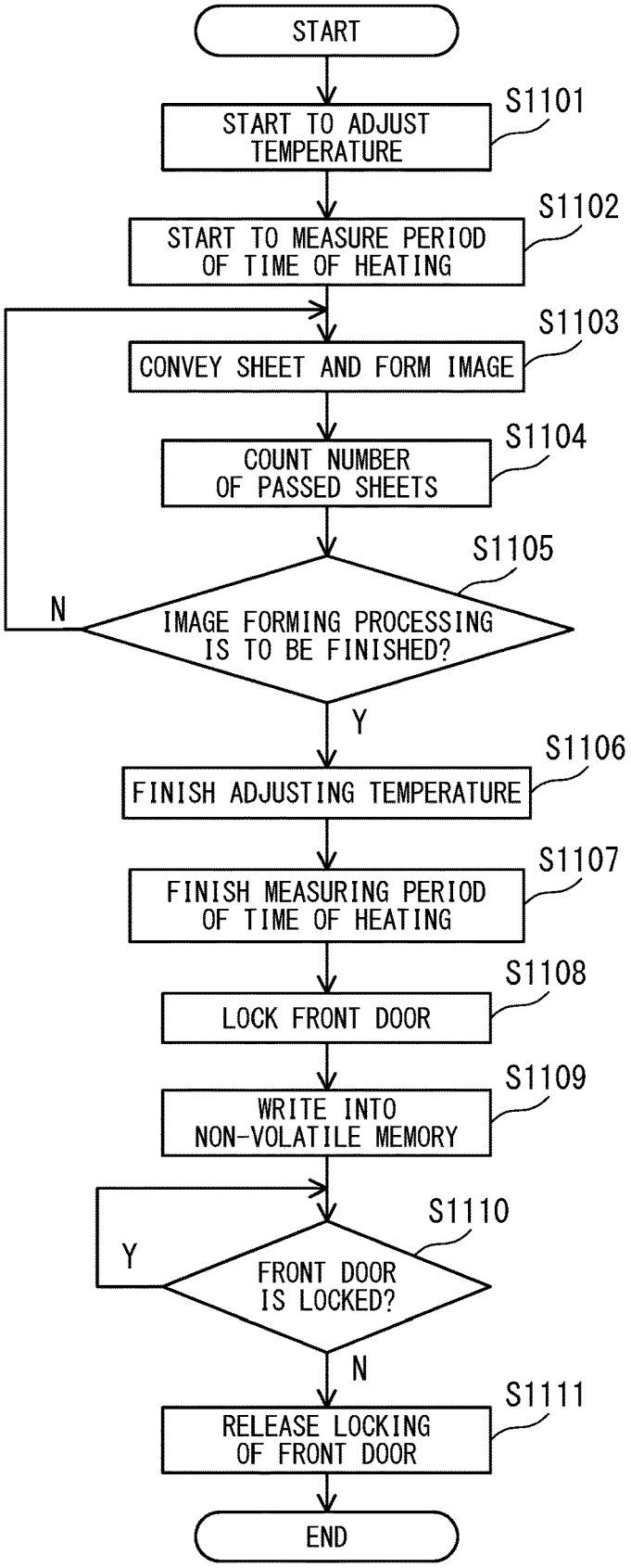
FIG. 8 is a flow chart for illustrating image forming processing.

FIG. 8 is a flow chart for illustrating the image forming processing. Data, for example, the usage amount is written into the non-volatile memory 191 of the fixing/conveying unit 350 by this processing. The system controller 151 starts this processing in accordance with an image forming instruction from the operation portion 152. Now, a description is given of processing relating to control of the fixing/conveying unit 350 in the image forming processing.

When the first CPU 151*a* of the system controller 151 has acquired an image forming instruction from the operation portion 152, the first CPU 151*a* starts to adjust the temperature of the fixing heater 177 (Step S1101). The first CPU 151*a* acquires, via the second CPU 171, a digital signal converted from a detection signal of the thermistor 175, and checks the temperature of the fixing heater 177. The first CPU 151*a* transmits a control signal that depends on the checked temperature of the fixing heater 177 to the second CPU 171. The second CPU 171 controls the AC driver 176 in accordance with this control signal to adjust the temperature of the fixing heater 177. The first CPU 151*a* starts to measure the period of time of heating by the fixing heater 177 (Step S1102).

The first CPU 151*a* conveys one page of sheet, and executes image forming processing (Step S1103). The first CPU 151*a* counts the number of sheets (number of passed sheets) that have passed through the fixing device 318 (Step S1104). The number of passed sheets is counted by installing a sensor configured to detect a sheet in the fixing device 318, and counting the number of times of detection of a sheet by this sensor, for example. The first CPU 151*a* determines whether to finish the image forming processing (Step S1105). The first CPU 151*a* determines whether to finish the image forming processing depending on whether image forming processing has been executed for the number of sheets specified by the image forming instruction, for example. When the image forming processing is not finished (Step S1105: N), the first CPU 151*a* repeatedly executes the processing of Step S1103 and Step S1104 until the image forming processing is finished.

When the image forming processing is determined to be finished (Step S1105: Y), the first CPU 151*a* finishes adjusting the temperature of the fixing heater 177 (Step S1106), and finishes measuring the period of time of heating by the fixing heater 177 (Step S1107). Next, the first CPU 151*a* turns on the solenoid lock 165 to lock the front door 93 in the closed state (Step S1108). After the front door 93 is locked, the first CPU 151*a* writes the counted number of passed sheets and the period of time of heating by the fixing heater 177 into the non-volatile memory 191 of the fixing/conveying unit 350 via the communication line 190 (Step S1109). The number of passed sheets and the period of time of heating are data, for example, the usage amount of the fixing/conveying unit 350.

When the first CPU 151*a* has finished writing the data into the non-volatile memory 191, the first CPU 151*a* determines whether the front door 93 is locked due to a jam removal processing cause described later (Step S1110). When the front door 93 is locked due to the jam removal processing cause (Step S1110: Y), the first CPU 151*a* waits until the jam removal processing cause is removed. When the front door 93 is not locked (Step S1110: N), the first CPU 151*a* turns off the solenoid lock 165 to release locking of the front door 93 (Step S1111).

The image forming processing is executed as described above, and the data, for example, the usage amount of the fixing/conveying unit 350 is written into the non-volatile memory 191. When the data is written into the non-volatile memory 191, the front door 93 covering the fixing/conveying unit 350 is locked in the closed state. As a result, even when the operator tries to draw out the fixing/conveying unit 350 from the main body of the image forming portion 301, the fixing/conveying unit 350 cannot be drawn out from the main body during write of data into the non-volatile memory 191. With this, abnormal end of write processing due to the disconnection between the system controller 151 and the fixing/conveying unit 350 during the write of data into the non-volatile memory 191 is prevented. Further, it is possible to prevent a failure of the non-volatile memory 191.

Processing at Time of Occurrence of Jam

When there is a possibility that a sheet is torn at the time of occurrence of a jam, the image forming apparatus 100 locks the front door 93 in the closed state, to thereby prevent each unit from being drawn out from the main body of the image forming portion 301. Whether the front door 93 is locked due to a jam removal processing cause determined in the processing of Step S1007 of FIG. 6 and the processing of Step S1110 of FIG. 8 relates to a locked state of the front door 93 at the time of occurrence of such a jam.

Figure 9:
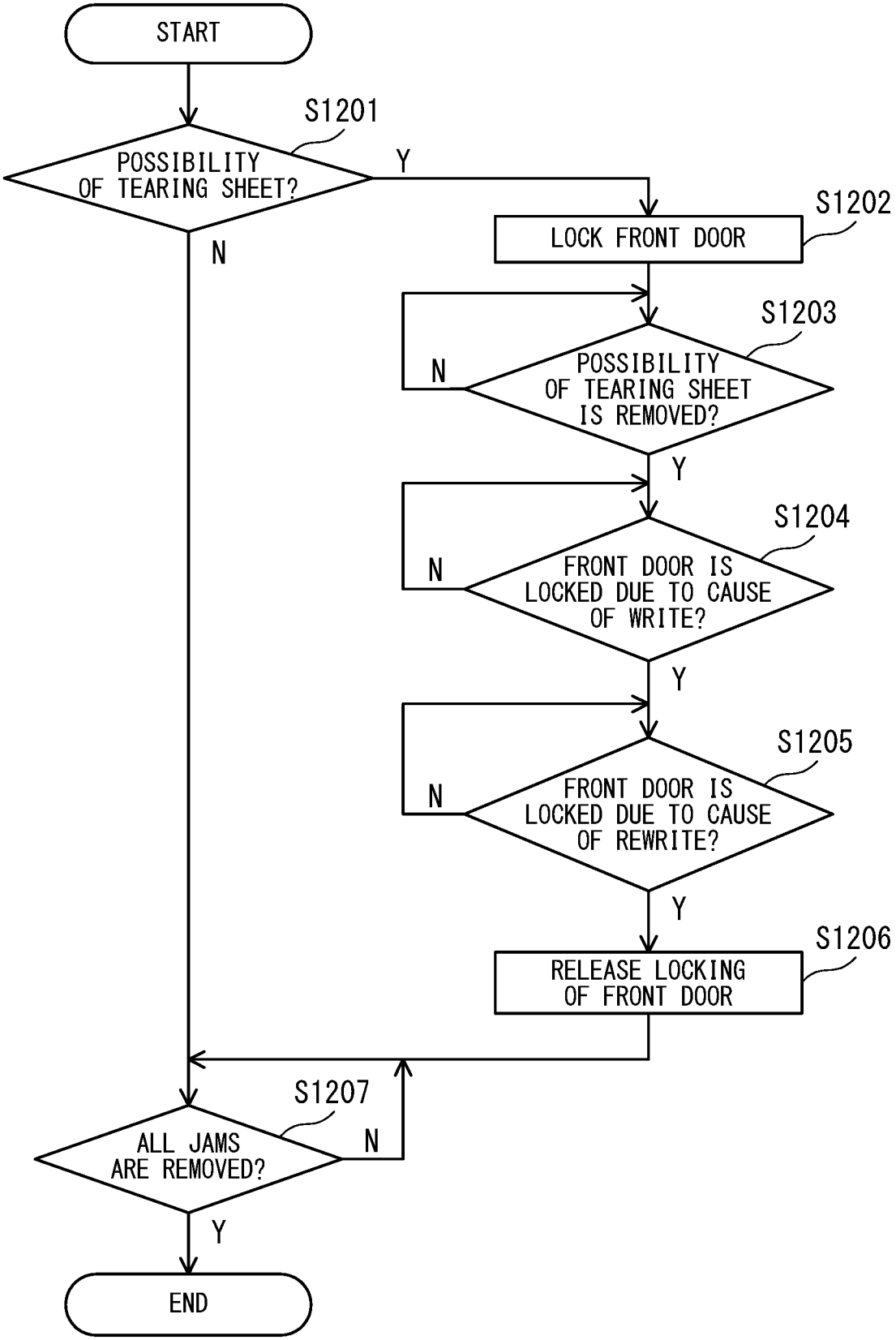
FIG. 9 is a flow chart for illustrating processing to be executed at a time of occurrence of a jam.

FIG. 9 is a flow chart for illustrating processing at the time of occurrence of a jam. Occurrence of a jam is detected based on results of detection by the first sensor group 159 and the second sensor group 178. For example, the first CPU 151*a* of the system controller 151 detects occurrence of a jam when a sensor has not detected a sheet within a predetermined period of time since start of conveyance of the sheet or when the sensor has detected the sheet continuously for a predetermined period of time or more. The first sensor group 159 and the second sensor group 178 each function as a jam detection unit.

The first CPU 151*a*, which has detected occurrence of a jam, determines whether the jam has a possibility of tearing a sheet (torn sheet) due to the procedure of jam handling operation based on the results of detection by the first sensor group 159 and the second sensor group 178 (Step S1201). A sheet may be torn when a jam has occurred at a portion between units of the conveyance path 327, for example. In the example of FIG. 1, a sheet may be torn when a jam has occurred between the conveyance rollers 307 and the conveyance rollers 306, between the sheet delivery rollers 319 and the sheet delivery rollers 324, between the sheet delivery rollers 319 and the conveyance rollers 320, and between the reverse rollers 321 and the conveyance rollers 322.

In a case where, as to the jam, there is a possibility of tearing a sheet (Step S1201: Y), the first CPU 151*a* turns on the solenoid lock 165 to lock the front door 93 in the closed state (Step S1202). After the front door 93 is locked, the first CPU 151*a* determines whether or not the possibility of tearing a sheet is removed (or exhausted) based on the results of detection by the first sensor group 159 and the second sensor group 178 (Step S1203). The operator is notified of a procedure of removing a sheet at the time of occurrence of a jam. The possibility of tearing a sheet is exhausted by the operator executing jam handling operation in accordance with the procedure to remove the sheet. The first CPU 151*a* waits until the possibility of tearing a sheet is removed (Step S1203: N).

When the possibility of tearing a sheet is removed (Step S1203: Y), the first CPU 151*a* determines whether the front door 93 is locked due to a cause of writing data into the non-volatile memory 191 (Step S1204). The first CPU 151*a* performs this determination depending on whether the processing of Step S1108 to Step S1111 of FIG. 8 is being executed. The first CPU 151*a* waits until the locking of the front door 93 due to the cause of writing data into the non-volatile memory 191 is released (Step S1204: N).

When the locking of the front door 93 due to the cause of writing data into the non-volatile memory 191 is released (Step S1204: Y), the first CPU 151*a* determines whether the front door 93 is locked due a cause of rewriting the computer program (Step S1205). The first CPU 151*a* performs this determination depending on whether the processing of Step S1005 to Step S1008 of FIG. 6 is being executed. The first CPU 151*a* waits until the locking of the front door 93 due to the cause of rewriting the computer program is released (Step S1205: N).

When the locking of the front door 93 due to the cause of rewriting the computer program is released (Step S1205: Y), the first CPU 151*a* turns off the solenoid lock 165 to release locking of the front door 93 (Step S1206).

After the locking is released, or when the jam does not have a possibility of tearing a sheet (Step S1201: N), the first CPU 151*a* waits until the jam is removed based on the results of detection by the first sensor group 159 and the second sensor group 178 (Step S1207: N). The locking of the front door 93 is released, and thus the operator can open the front door 93, access the internal structure of the image forming portion 301, and remove a sheet that has caused the jam. The first CPU 151*a* determines that the jam is removed when the first CPU 151*a* has detected the removal of the sheet based on the results of detection by the first sensor group 159 and the second sensor group 178. When the jam is removed (Step S1207: Y), the first CPU 151*a* finishes the processing executed at the time of occurrence of a jam.

As described above, when a sheet has a possibility of being torn at the time of occurrence of a jam, the front door 93 is locked in the closed state so as to prevent separation of a unit that may tear the sheet. With this, a sheet is prevented from being torn due to an operation of removing a jam.

In at least one embodiment described above, the front door 93 is locked in the closed state so that the fixing/conveying unit 350 is not drawn out from the main body while the system controller 151 on the main body side is rewriting the computer program of the fixing/conveying unit 350. With this configuration, abnormal end of rewrite processing due to the disconnection between the system controller 151 and the fixing/conveying unit 350 during the rewrite of data is prevented. The rewrite of the computer program is normally finished, to thereby maintain a combination of computer programs of the system controller 151 and the unit that achieves normal operation.

In the above description, the fixing/conveying unit 350 is given as an example. However, similar processing can be executed for another unit included in the image forming apparatus 100. It suffices that this unit can be drawn out from the main body when a door that can be locked in a closed state is set to an opened state, and this unit stores a rewritable computer program. This unit operates by storing a computer program into a ROM and causing a CPU to execute the computer program by using a RAM as a working area. For example, similarly to the fixing/conveying unit 350 in at least one embodiment, a drum unit including the photosensitive drum 309 can be drawn out from the main body when the front door 93 is set to the opened state, and stores a rewritable computer program. The drum unit operates by executing a computer program. In this manner, the unit is prevented from being drawn out from the main body when the computer program of the unit is rewritten, or data, for example, the usage amount is written. As a result, the computer program is rewritten safely, and data, for example, the usage amount is written safely.

Further, in at least one embodiment, a configuration in which the front door 93 is locked to prevent the fixing/conveying unit 350 from being drawn out from the image forming apparatus 100 is employed. However, the configuration is not limited thereto. For example, the fixing/conveying unit 350 may be prevented from being drawn out from the image forming apparatus 100 by installing an engaged member in the fixing/conveying unit 350 and causing an engaging member installed in the image forming apparatus 100 to engage with the engaged member. Specifically, for example, while a computer program is being rewritten or data is being written, the fixing/conveying unit 350 may be prevented from being drawn out from the image forming apparatus 100 by setting the front door 93 openable and causing the engaging member installed in the image forming apparatus 100 to engage with the engaged member installed in the fixing/conveying unit 350.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2019-126695, filed Jul. 8, 2019 and No. 2020-084984, filed May 14, 2020, which are hereby incorporated by reference herein in their entirety.

What is claimed is:

1. An image forming apparatus, comprising:

an image forming unit, which is detachably mounted to the image forming apparatus, and includes an image forming portion configured to form an image on a sheet, the image forming unit including a storage unit configured to store a computer program for forming an image on the sheet;

a controller configured to control the image forming unit mounted to the image forming apparatus;

a detector configured to detect whether the image forming unit and the controller are connected to each other;

a door to be opened to draw out the image forming unit from the image forming apparatus; and a locking unit configured to switch between a locked state, in which the door is prevented from being opened, and an unlocked state, in which the door is allowed to be opened, wherein the controller is configured to rewrite the computer program stored in the storage unit under a state in which the locking unit is in the locked state and the detector detects the connection between the image forming unit and the controller.

2. The image forming apparatus according to claim 1, wherein the controller is configured to start rewriting the computer program under the state in which the locking unit is in the locked state and the detector detects the connection between the image forming unit and the controller.

3. The image forming apparatus according to claim 1, wherein the locking unit is configured to switch from the locked state to the unlocked state when the controller has finished rewriting the computer program.

4. The image forming apparatus according to claim 1, wherein the image forming portion includes a fixing unit configured to fix an image to the sheet by heat.

5. The image forming apparatus according to claim 1,
wherein the image forming portion includes a fixing unit configured to fix an image to the sheet by heat,
wherein the controller includes a counter configured to count the number of sheets that have passed through the fixing unit, and
wherein the controller is configured to write a result of the counting by the counter into the storage unit under the state in which the locking unit is in the locked state and the detector detects the connection between the image forming unit and the controller.

6. The image forming apparatus according to claim 1,
wherein the image forming portion includes a heater, and a fixing unit configured to fix an image to the sheet by heat of the heater,
wherein the controller includes a measurement unit configured to measure a period of time of the heating by the heater, and
wherein the controller is configured to write a result of the measurement by the measurement unit into the storage unit as the data under the state in which the locking unit is in the locked state and the detector detects the connection between the image forming unit and the controller.

7. The image forming apparatus according to claim 1, further comprising a jam detection unit configured to detect a jam of the sheet,
wherein the locking unit is configured to switch from the unlocked state to the locked state when the jam detection unit has detected occurrence of the jam.

8. The image forming apparatus according to claim 1, wherein the locking unit is configured to prevent the door from being opened by engaging with an engaged portion installed on the door under the locked state.

9. An image forming apparatus, comprising:
an image forming unit, which is detachably mounted to the image forming apparatus, and includes an image forming portion configured to form an image on a sheet, the image forming unit including a storage unit configured to store data indicating a usage amount of the image forming unit at a time of forming an image on the sheet;
a controller, which is installed in the image forming apparatus to which the image forming unit is mounted, and is configured to control the image forming unit;
a detector configured to detect whether the image forming unit and the controller are connected to each other;
a door to be opened to draw out the image forming unit from the image forming apparatus; and
a locking unit configured to switch between a locked state, in which the door is prevented from being opened, and an unlocked state, in which the door is allowed to be opened,
wherein the controller is configured to write the data into the storage unit under a state in which the locking unit is in the locked state and the detector detects the connection between the image forming unit and the controller.

10. The image forming apparatus according to claim 9, wherein the controller is configured to start writing the data under the state in which the locking unit is in the locked state and the detector detects the connection between the image forming unit and the controller.

11. The image forming apparatus according to claim 9, wherein the locking unit is configured to switch from the locked state to the unlocked state when the controller has finished writing the data.

12. The image forming apparatus according to claim 9, wherein the image forming portion includes a fixing unit configured to fix an image to the sheet by heat.

13. The image forming apparatus according to claim 12,
wherein the controller includes a counter configured to count the number of sheets that have passed through the fixing unit, and
wherein the controller is configured to write a result of the counting by the counter into the storage unit as the data.

14. The image forming apparatus according to claim 9,
wherein the image forming portion includes a heater, and a fixing unit configured to fix an image to the sheet by heat of the heater,
wherein the controller includes a measurement unit configured to measure a period of time of the heating by the heater, and
wherein the controller is configured to write a result of the measurement by the measurement unit into the storage unit as the data.

15. The image forming apparatus according to claim 9, further comprising a jam detection unit configured to detect a jam of the sheet,
wherein the locking unit is configured to switch from the unlocked state to the locked state when the jam detection unit has detected occurrence of the jam.

16. The image forming apparatus according to claim 9, wherein the locking unit is configured to prevent the door from being opened by engaging with an engaged portion installed on the door under the locked state.

17. An image forming apparatus, comprising:
an image forming unit, which is detachably mounted to the image forming apparatus, and includes an image forming portion configured to form an image on a sheet, the image forming unit including a storage unit configured to store a computer program for forming an image on the sheet;
a controller, which is installed in the image forming apparatus to which the image forming unit is mounted, and is configured to control the image forming unit;
a detector configured to detect whether the image forming unit and the controller are connected to each other;
a door to be opened to draw out the image forming unit from the image forming apparatus; and
a locking unit configured to switch between a locked state, in which the image forming unit is prevented from being drawn out, and an unlocked state, in which the image forming unit is allowed to be drawn out,
wherein the controller is configured to rewrite the computer program stored in the storage unit under a state in which the locking unit is in the locked state and the detector detects the connection between the image forming unit and the controller.

18. The image forming apparatus according to claim 17, wherein the controller is configured to start rewriting the computer program under the state in which the locking unit is in the locked state and the detector detects the connection between the image forming unit and the controller.

19. The image forming apparatus according to claim 17, wherein the locking unit is configured to switch from the locked state to the unlocked state when the controller has finished rewriting the computer program.

20. The image forming apparatus according to claim 18, wherein the image forming portion includes a fixing unit configured to fix an image to the sheet by heat.

21. The image forming apparatus according to claim 17,
wherein the image forming portion includes a fixing unit configured to fix an image to the sheet by heat, wherein the controller includes a counter configured to count the number of sheets that have passed through the fixing unit, and wherein the controller is configured to write a result of the counting by the counter into the storage unit under the state in which the locking unit is in the locked state and the detector detects the connection between the image forming unit and the controller.

22. The image forming apparatus according to claim 17, wherein the image forming portion includes a heater, and a fixing unit configured to fix an image to the sheet by heat of the heater, wherein the controller includes a measurement unit configured to measure a period of time of the heating by the heater, and wherein the controller is configured to write a result of the measurement by the measurement unit into the storage unit as the data under the state in which the locking unit is in the locked state and the detector detects the connection between the image forming unit and the controller.

23. The image forming apparatus according to claim 17, further comprising a jam detection unit configured to detect a jam of the sheet, wherein the locking unit is configured to switch from the unlocked state to the locked state when the jam detection unit has detected occurrence of the jam.

24. An image forming apparatus, comprising:

an image forming unit, which is detachably mounted to the image forming apparatus, and includes an image forming portion configured to form an image on a sheet, the image forming unit including a storage unit configured to store data indicating a usage amount of the image forming unit at a time of forming an image on the sheet;

a controller, which is installed in the image forming apparatus to which the image forming unit is mounted, and is configured to control the image forming unit;

a detector configured to detect whether the image forming unit and the controller are connected to each other;

a door to be opened to draw out the image forming unit from the image forming apparatus; and a locking unit configured to switch between a locked state, in which the door is prevented from being opened, and an unlocked state, in which the door is allowed to be opened, wherein the controller is configured to write the data into the storage unit under a state in which the locking unit is in the locked state and the detector detects the connection between the image forming unit and the controller.

25. The image forming apparatus according to claim 24, wherein the controller is configured to start writing the data under the state in which the locking unit is in the locked state and the detector detects the connection between the image forming unit and the controller.

26. The image forming apparatus according to claim 24, wherein the locking unit is configured to switch from the locked state to the unlocked state when the controller has finished writing the data.

27. The image forming apparatus according to claim 24, wherein the image forming portion includes a fixing unit configured to fix an image to the sheet by heat.

28. The image forming apparatus according to claim 27, wherein the controller includes a counter configured to count the number of sheets that have passed through the fixing unit, and wherein the controller is configured to write a result of the counting by the counter into the storage unit as the data.

29. The image forming apparatus according to claim 24, wherein the image forming portion includes a heater, and a fixing unit configured to fix an image to the sheet by heat of the heater, wherein the controller includes a measurement unit configured to measure a period of time of the heating by the heater, and wherein the controller is configured to write a result of the measurement by the measurement unit into the storage unit as the data.

30. The image forming apparatus according to claim 24, further comprising a jam detection unit configured to detect a jam of the sheet, wherein the locking unit is configured to switch from the unlocked state to the locked state when the jam detection unit has detected occurrence of the jam.

* * * * *